US006174634B1

(12) United States Patent
De Bastiani

(10) Patent No.: US 6,174,634 B1
(45) Date of Patent: Jan. 16, 2001

(54) MANUFACTURE OF TRANSFER DECALCOMANIAS USING ULTRAVIOLET CURE IN AND ADHESIVE TECHNOLOGY

(75) Inventor: Norman P. De Bastiani, S. Hadley, MA (US)

(73) Assignee: Chartpak, Inc., Leeds, MA (US)

( * ) Notice: Under 35 U.S.C. 154(b), the term of this patent shall be extended for 0 days.

(21) Appl. No.: 09/244,631

(22) Filed: Feb. 4, 1999

(51) Int. Cl.[7] ..... G03G 13/16
(52) U.S. Cl. ..... 430/47; 428/354
(58) Field of Search ..... 428/354, 352; 430/126, 47

(56) References Cited

U.S. PATENT DOCUMENTS 4,786,537 * 11/1988 Sasaki ..... 428/352
5,560,796 * 10/1996 Yoshimura ..... 428/354

* cited by examiner

*Primary Examiner*—John Goodrow
(74) *Attorney, Agent, or Firm*—Schweitzer Cornman Gross & Bondell LLP

(57) ABSTRACT

Conventional methods of manufacture of transfer decalcomanias utilizing traditional solvent evaporative ink and adhesive technology are replaced by the present process utilizing ultraviolet (U.V.) cure inks and adhesive technology to produce a better product in a simpler, less costly manufacturing operation.

13 Claims, 1 Drawing Sheet

MANUFACTURE OF TRANSFER DECALCOMANIAS USING ULTRAVIOLET CURE IN AND ADHESIVE TECHNOLOGY

BACKGROUND OF THE INVENTION

Dry transfer products (typically referred to as decalcomanias) are well known in the art. Such products are composed of a carrier film screen printed with graphic designs i.e., lettering, craft art, logos, tole painting, signage, symbols, etc., and subsequently adhesived and protected with a silicone coated release paper. The decalcomania is transferred to the intended receiving surface by removing the protective silicone coated release paper and positioning the decalcomania with the adhesive side against the receiving surface and contacting the adhesive by burnishing the carrier film on the opposite side and slowly peeling away the carrier film leaving only the screen ink formed decalcomania attached to the receiving surface.

Decalcomanias are presently manufactured using solvent based screen inks and adhesives.

An example of the above described prior art process is exemplified by U.S. Pat. No. 3,847,725 wherein use of a carrier film, solvent base ink and adhesives are taught. This patent describes a single color decalcomania whereas it also applies to spot and halftone screen printing.

U.S. Pat. No. 3,847,725 describes a carrier film coated with a non-extensible highly cross-linked polymeric coating that is insoluble to organic solvents; a solvent/resin evaporative ink and a solvent/elastomeric low tack solvent evaporative pressure sensitive adhesive.

In summary all previously described art teaches a carrier film with a no-stick surface coating, a solvent evaporative ink that will release from the no-stick surface and a solvent evaporative pressure sensitive adhesive that will aid transfer and bond the indica to the receiving surface.

Such processes necessarily require special efforts and compliance to OSHA and DEP regulations when handling solvent base inks and adhesives. For example, OSHA requires proper labeling and handling for employee health and accident safety and DEP requires special permitting and annual reporting of the solvent emissions, called volatile organic compounds or (VOC's). If emissions exceed "low quantity generator status" an expensive solvent oxidizer installation will be required to process the VOC's before discharging them to the atmosphere.

The present invention eliminates the following disadvantages of using solvent evaporative inks:

1. Atmosphere pollution from solvent VOC's.
2. Time consuming and complicated solvent emission reporting to the DEP.
3. Implementing and auditing OSHA required safety procedures for solvent inks and adhesives.
4. Solvent evaporative ink tend to dry in the screens and require washing out every 100–500 sheets resulting in costly loss in production efficiency.
5. Cost of expensive drying ovens needed to evaporate the solvents out of the printed screen ink.
6. Drying ovens require valuable manufacturing floor space.
7. Inability to efficiently halftone screen print above 75 lines per inch resolution.
8. Cost of expensive oxidizer to treat the VOC emissions prior to discharge into the atmosphere.

BRIEF DESCRIPTION OF THE PRESENT INVENTION

The present invention eliminates the need for solvent base screen inks and adhesives in the manufacture of decalcomanias. Rather, this invention employs ultraviolet (U.V.) cure inks and adhesives in the manufacture of decalcomanias. U.V. curable inks produce decalcomanias with tougher ink films resulting in improved scuff and abrasion resistance. U.V. cure systems also increase process speed and improve ability to print finer halftone screens (100–150 lines per inch resolution) because U.V. ink and adhesive will not dry in the screen.

U.V. screen inks and adhesives will also allow the production of decalcomania in a less hazardous solvent free work place while protecting the environment by eliminating VOC's.

The decalcomania dry transfer product of the present invention comprises (see FIG. 1):

(1) a carrier film;

(2) a non-stick coating applied to the carrier film;

(3) a U.V. curable ink for producing the desired indicia which is applied to the non-stick coating;

(4) a U.V. curable pressure-sensitive adhesive applied over the indicia formed in feature (3); and (5) a protective release paper or plastic coating.

The key inventive features of the present invention reside primarily in features (3) and (4), and the elimination of the prior art solvent steps.

The present process is particularly suitable to produce a single color, spot color, halftone color or a combination of the above screen printing decalcomania, while eliminating the disadvantages of using solvent evaporating ink previously described.

DETAILED DESCRIPTION

Figure 1:
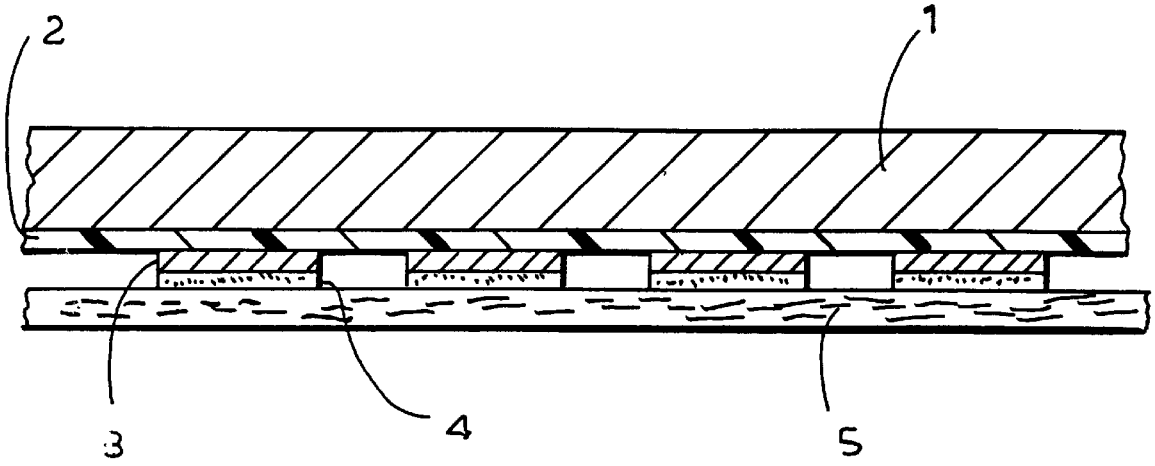
FIG. 1 is a cross-section of a dry transfer sheet embodying the present invention and the foregoing elements (1)–(5) described above.

The present invention may be readily understood by referring to FIG. 1 and amplifying each of the component elements of the present dry transfer sheet.

As depicted in FIG. 1:

(1) is the base carrier film similar to those conventionally used, such as described in U.S. Pat. No. 3,847,725 which description is incorporated by reference. The carrier film can be polyester, polyethylene, polystyrene, polypropylene, a vinyl polymer or the like. The carrier paper can be densified Kraft paper, parchment, transparent paper, etc.

(2) denotes a polymeric coating applied to the carrier film. The polymeric coating may be a polymer as described in col. 2 of U.S. Pat. No. 3,847,725 which is incorporated by reference. Thermosetting polymers and especially thermosetting acrylics are particularly useful. Such polymers must be substantially non-extensible. A modified silicone polymer coating may also be used next to the polymeric coating.

In either case to be useful, the ink release values from the polymeric coating should be between 2–5 grams per inch when measured as described by the pressure sensitive tape council's test method number PSTC#-1 and allow the U.V. cure screen ink to be printed to high printing standards and quality.

(3) denotes the decalcomania formed by use of U.V. inks according to the present invention. Such inks are formulated from a blend of monomers, oligomers, photoinitiators, pigments, additives, modifiers and synergist. When exposed to U.V. energy, in the 200–400 nanometer range for a fraction of a second, the photoinitiator will absorb U.V. energy, and start the polymerization of the oligomer and monomer until it is completely cross linked changing the U.V. ink from a liquid to a 100% cured solid.

The proper selection of monomers and oligomers, etc. will give the cured U.V. ink the desired physical properties such as hardness, flexibility, clarity, color, and releaseability from the carrier film.

1. Oligomers are the resin backbone part of the formula. Ebecryl #1755 is an acrylic oligomer blended with TRPGDA-DEO monomer featuring flexibility. Ebecryl #6700 is an acrylated aromatic urethane oligomer featuring toughness and abrasion resistance. They are both manufactured by UCB Chemicals Corp., Smyra, Ga.
2. Monomers crosslink with the oligomer resins to form a solid. They also act as diluents and contribute to the physical properties of the solid ink film.

Ebecryl TRPGDA is a tripropylene glycol diacrylate. It contributes flexibility, water resistance, low viscosity, good cure speed, and good solvency for acrylated oligomers without imparting brittleness.

Ebecryl TRPGDA-DEO is a purified grade of tripropylene glycol diacrylate. It has the same physical properties as TRPGDA but exhibits low odor.

3. Photoinitiator can be called a catalyst. It starts the polymerization between the oligomer and the monomer. When radiated with U.V. light the photoinitiator will absorb U.V. energy and generate free radicals which cause the oligomer and monomer to crosslink into a solid polymerized ink film. Irgacure 907 and Irgacure 1700 are manufactured by Ciba Specialties Chemical Co., Tarrytown, N.Y.
4. Pigment is used to impart color to the U.V. crosslinked polymer ink film. Pennco #981 black and Pennco #9R52 red are pigment paste manufactured by Penn Color, Inc., Doylestown, Pa.
5. Various Additives FL 430 is a surfactant manufactured by 3M Corp., St. Paul, Minn. It reduces the surface tension of the ink and facilitates wetting of the pigments and receiving surfaces. L405 is a defoamer manufactured by Drew Chemical Company (Division of Ashland Chemical Co.), Boonton, N.J. L405 is added to the ink to control fisheyes, cratering, etc. Cabosil #M-5 is a fumed silica added to flatten the gloss and improve viscosity. It is manufactured by the Cabot Corporation, Tuslola, Ill. Ebecryl P115 is an amine synergist. It is an additive used to increase the cure speed of the U.V. ink and imparts low odor.

(4) denotes the U.V. curable pressure sensitive adhesive layer. Such U.V. curable pressure sensitive adhesives can be purchased from various manufacturers. Two manufacturers are: RAD-CURE Corp., Fairfield, N.J. (their product is #UV12PS-8K) and Acheson Colloids, Port Huron, Mich. (their product #ML25251).

(5) A protective release paper denoted as (5) is used to protect the adhesive and to prevent the indicia from pre-release or pre-transfer to an unwanted surface. This is a conventional feature. A paper such as vegetable parchment, tissue, or densified Kraft paper, is silicone coated to provide the protection.

The components making up the U.V. inks are exemplified as follows:

1. Oligomers and Additives—supplied by UCB Chemicals Corp., Smyrna, Ga. 30080 EB 220, EB 745, EB 1701, EB 1710, EB 1755, EB 4827 and EB 1755.
2. Monomers—supplied by UCB Chemical Corp. EB CL1039, HDODA, TRPGDA, TRPGDA-DEO PETA.K.
3. Photoinitiators—supplied by UCB Chemical Corp. EB P37, Irgacure 1700*, Irgacure 907*, Benzophenone, EB P115, DVROCUR 1173*, supplied by Ciba Corp.
4. Synergist—supplied by UCB Chemical Corp., EB P115, EB P104.
5. Pigments—
   Pennco 981 Black Pigment paste*
   Pennco 9R52 Red pigment paste*
   Pennco 9579 blue pigment paste*
   Pennco 9W7 white pigment paste *
   * supplied by Penn Color Inc.
6. Additives—

FC-430 fluorocarbon surfactant, supplied by 3M Co. Carnavba Wax, Slip Agent, supplied by F.B. Ross Co., Inc.

L-405 Defoamer, supplied by Drew Chemical Co. Cabosil M-5 Fumed Silica, supplied by Cabot Corp. DC-193 Silicone Wetting Agent, supplied by Dow Corning.

A typical formula for a black U.V. cure ink is as follows:

| | | 100 Parts by weight |
|---|---|---|
| Oligomer | EB 1755 | 47.0 |
| Monomer | TRPGPA-DEO | 19.0 |
| Pigment | PENNCO 981 | 21.0 |
| Photoinitiator | IRGACURE 1700 | 6.0 |
| Surfactant | FC430 | 0.5 |
| Defoamer | L405 | 0.5 |
| Silica | Cabosil/M-5 | 1.0 |
| Synergist | P115 | 5.0 |

A typical red U.V. Cure Ink is as follows:

| | | |
|---|---|---|
| Oligomer | 6700 | 30.0 |
| Monomer | TRPG-DA | 26.0 |
| Pigment | 9R52 | 31.0 |
| Photoinitiator | IRGACURE 907 | 6.0 |

Surfactant, defoamer, silica and synergist are the same as to nature and quantity as the above U.V. cure ink composition.

Additives and modifiers can be added to the inks and adhesives to provide flow, slip, hold out, viscosity, flexibility adjustments as deemed necessary.

U.V. cure ink and adhesive printing conditions are the same as used for standard solvent base ink and adhesive printing which is in itself generally well known.

An illustrative description of the present process is as follows:

Printing Screen: Mesh for ink, 300–400 threads per ink in either stainless steel or polyester material stretched to a minimum tension of 20–24 newtons.

A direct photo emulsion stencil depicting the graphics to be printed is firmly adhered and anchored to the mesh.

Press: Any standard flatbed or cylinder or web press capable of controlling registration, and squeegee speed and pressure.

U.V. Cure Process: A standard U.V. cure unit equipped with one or two 300 watt per inch mercury vapor lamps fitted with a standard elliptical reflector. Cure speed is normally in the range of 50 to 75 feet per minute with exposure to 200–400 monometers for a fraction of a second. For either U.V. cure ink and/or U.V. cure adhesive.

Various modifications may suggest themselves to those skilled in the art.

Having described the present invention, that which is sought to be protected is set forth in the following claims.

What is claimed is:

1. A dry transfer product comprising a carrier sheet, a coating applied to said sheet, an ink composition capable to form desired indicia and which is being received by said coating in a solvent-free carrier, and which has been cured by the application of ultraviolet (U.V.) energy to fix the desired indicia in place, and a U.V. curable pressure sensitive adhesive not requiring solvent for application is applied to said U.V. cured indicia.

2. The product of claim 1, wherein said coating is selected from the group consisting of a thermosetting polymer and a silicone coated polymer adapted to receive said U.V. curable ink composition.

3. The product of claim 1, wherein said ink composition contains a member of the group consisting of a monomer, oligomer, photoinitiator, additives, and pigment.

4. The product of claim 3, wherein said ink composition comprises a monomer, oligomer and photoinitiator.

5. The dry transfer product of claim 1, which contains on its outer surface a protective paper coated with a low friction medium to be readily removed therefrom.

6. The pressure sensitive adhesive of claim 1 which contains members of the group consisting of monomers, oligomers, photoinitiators and modifiers.

7. The fixed desired indicia of claim 1 resulting from subjecting said ink composition to a wavelength of 200–400 nanometers of ultraviolet exposure.

8. The dry transfer product of claim 1, wherein said ink composition comprises an acrylic oligomer and a tripropylene glycol diacrylate monomer.

9. The dry transfer product of claim 8, wherein said ink composition further comprises a photoinitiator for catalyzing the polymerization between said oligomer and said monomer.

10. A process for producing a dry transfer product wherein a coating is applied to a carrier sheet and an ink composition capable of forming desired indicia is applied to said coating, the improvement which comprises employing a solvent-free carrier and ink composition capable of being cured by the application of ultra violet (U.V.) energy to fix the desired indicia in place, exposing the resultant product to sufficient U.V. energy to effect curing, and then applying a U.V. curable pressure sensitive adhesive to said U.V. cured indicia in the absence of solvent.

11. The process of claim 10 wherein the indicia and carrier are exposed to 200–400 monometers of U.V. energy to effect curing.

12. The process of claim 10 wherein the ink composition to be cured comprises an oligomer, monomer, photoinitiator and a pigment.

13. The process of claim 12 wherein said oligomer is an acrylic and said monomer is a tripropylene glycol diacrylate.

* * * * *